US008936607B2

(12) United States Patent
Shekalim

(10) Patent No.: US 8,936,607 B2
(45) Date of Patent: Jan. 20, 2015

(54) METHOD AND SYSTEM FOR HAIR REMOVAL

(75) Inventor: Avraham Shekalim, Nesher (IL)

(73) Assignee: Liosonic Ltd., Moshav Yokneam (IL)

( * ) Notice: Subject to any disclaimer, the term of this patent is extended or adjusted under 35 U.S.C. 154(b) by 213 days.

(21) Appl. No.: 13/695,202

(22) PCT Filed: Apr. 28, 2011

(86) PCT No.: PCT/IL2011/000340

§ 371 (c)(1),
(2), (4) Date: Oct. 29, 2012

(87) PCT Pub. No.: WO2011/135570

PCT Pub. Date: Nov. 3, 2011

(65) Prior Publication Data

US 2013/0053869 A1 Feb. 28, 2013

Related U.S. Application Data

(60) Provisional application No. 61/329,565, filed on Apr. 30, 2010, provisional application No. 61/350,059, filed on Jun. 1, 2010.

(51) Int. Cl.
*A61B 17/50* (2006.01)
*A45D 26/00* (2006.01)

(52) U.S. Cl.
CPC ..... *A45D 26/0057* (2013.01); *A45D 2200/207* (2013.01)
USPC ..... 606/133

(58) Field of Classification Search
USPC ..... 606/9, 36, 131, 133, 210, 211
See application file for complete search history.

(56) References Cited

U.S. PATENT DOCUMENTS

| | | | | |
|---|---|---|---|---|
| 4,830,004 | A | 5/1989 | Alazet | |
| 5,133,722 | A * | 7/1992 | Avrahami et al. | 606/133 |
| 5,176,690 | A | 1/1993 | Gross et al. | |
| 5,281,233 | A * | 1/1994 | Dolev | 606/133 |
| 5,507,753 | A * | 4/1996 | Iwasaki et al. | 606/133 |
| 6,045,559 | A * | 4/2000 | Sueyoshi et al. | 606/133 |
| 6,544,259 | B1 * | 4/2003 | Tsaliovich | 606/36 |
| 6,730,099 | B1 * | 5/2004 | Kreutz et al. | 606/133 |
| 8,636,750 | B2 * | 1/2014 | Berzak et al. | 606/133 |
| 2007/0173746 | A1 | 7/2007 | Barzilay et al. | |
| 2009/0005765 | A1 * | 1/2009 | Oostman et al. | 606/9 |
| 2011/0238085 | A1 * | 9/2011 | Berzak et al. | 606/133 |
| 2013/0331863 | A9 * | 12/2013 | Berzak et al. | 606/133 |

* cited by examiner

*Primary Examiner* — Jonathan W Miles
(74) *Attorney, Agent, or Firm* — Mark M. Friedman

(57) ABSTRACT

A hair removal system configured to destroy germinative cells at a base of at least one hair follicle is provided. The system comprises a casing and at least one pluck-head configured to trap at least one hair, and at least one oscillator mechanically coupled to the pluck-head and to the casing. The oscillator is configured to vibrate the pluck-head such that when the hair is trapped by the pluck-head, vibrations transmitted to the base are sufficient to destroy the germinative cells. A method of using the same is also disclosed.

27 Claims, 15 Drawing Sheets

METHOD AND SYSTEM FOR HAIR REMOVAL

FIELD OF THE INVENTION

Embodiments of the present invention relate to hair removal. More specifically, embodiments described herein relate to a hand-held device for providing long term hair removal and a method of its function.

BACKGROUND

The removal of body hair is often considered desirable for cosmetic or other reasons. Common hair removal methods include shaving, plucking, waxing, chemical depilation and the like. Such methods may be effective at removing the visible extradermal portion of a hair follicle and handheld devices may be provided, such as shavers, rotary epilators and the like, which may be suitable for home use. However these techniques are generally not considered long term hair removal solutions as they do not effect a hairs regenerative ability.

In order to provide long term hair removal professional treatment by an expert is generally sought. Epilation techniques may be used which damage the vital root of the hair follicle beneath the skin. Examples of epilation techniques include electrolysis, laser and ultrasonic treatments. These treatments aim to destroy the vital cells at the base of the hair possibly by heating the water in the follicle thereby causing the germinative hair cells to coagulate. Such treatments are difficult to perform and devices provided for their performance are difficult to operate by an untrained user.

For example, in ultrasonic treatments the base of the hair follicle may be heated by acoustic waves transmitted to the root either via the surrounding skin or through the hair follicle itself. PCT Application International Publication Number WO 2005/079687 titled 'Method and Device for Removing Hair' to Applisonix Ltd describes a possible acoustic method of treating unwanted hair. The method involves transmitting acoustic waves through the hair so as to generate heat at a follicle, a dermal papilla, a hair bulge and/or a germinal matrix of the hair. It is hoped that this is sufficient to damage or destroy the follicle, the dermal papilla, the hair bulge and/or the germinal matrix.

PCT Application International Publication Number WO 2009/150645 titled 'Device for Applying High-Frequency Vibrations to Hair for Removing Same' to Applisonix Ltd describes a device for applying such vibrations to hair. The device includes a pair of tongs having hair-gripping ends capable of being driven into high-frequency vibrations with respect to each other; and a transducer coupled to at least one of the tongs for converting an AC voltage to mechanical vibrations for driving the hair-gripping end into vibrations. The vibrations are then transmitted through the hair follicle to generate sufficient heat within the body to facilitate removal of the unwanted hair. According to WO 2009/150645, the transducer vibrates the hair at very high frequencies within the range 100-500 KHz, preferably 100-350 KHz, and produces a displacement of 5-20 microns.

The hair removal device of WO 2009/150645 requires that hairs need to be gripped by individual pairs of tongs in order to provide the acoustic coupling necessary to enable epilation. It will be appreciated that such a device is not suitable for non-expert home use.

Furthermore, many hair removal treatments are painful to apply causing significant discomfort to the subject having the treatment. Alternative less painful treatments are therefore highly sought after.

The need remains therefore for a convenient and intuitive long term hair removal device which may be suitable for domestic use. The various embodiments described herein address this need.

SUMMARY OF THE EMBODIMENTS

It is according to one aspect of the invention to present a hair removal system configured to destroy germinative cells at a base of at least one hair follicle. According to some embodiments, the system comprises: a casing; at least one pluck-head configured to trap the at least one hair; at least one oscillator mechanically coupled to the pluck-head and to the casing, the at least one oscillator configured to vibrate the pluck-head such that when a hair is trapped by the pluck-head, vibrations transmitted to the base are sufficient to destroy the germinative cells.

According to some embodiments, the pluck-head comprises a single unit. For example, the pluck-head may comprise at least one comb having a plurality of movable teeth. Typically, the system may further comprise a pluck control unit configured to activate the pluck-head to trap the at least one hair. Optionally, the pluck control unit comprises at least one actuator and at least one force transmission frame. Variously, at least one actuator may be selected from at least one of a group consisting of: a piezoelectric element, a motor, a solenoid and combinations thereof. Optionally, the pluck-head is configured to engage a plurality of hairs.

In noted embodiments, the oscillator comprises a transducer. The transducer may be selected from at least one of a group consisting of: a piezoelectric element, a motor, a solenoid and combinations thereof. Optionally, the grip actuator may itself comprise the oscillator. Typically, the oscillator further comprises a spring. In some embodiments the oscillator is configured to vibrate at a frequency below 150 kilohertz.

Advantageously, the system may further comprise a frame-displacement mechanism. Optionally, the frame-displacement mechanism may be configured to drive the pluck-head forward relative to the casing. Additionally, or alternatively, the frame-displacement mechanism may be configured to lift the pluck-head thereby pulling on the at least one hair held thereby.

In certain embodiments, the frame-displacement mechanism comprises an eccentric shaft coupled to a displacement carriage. Accordingly, the frame-displacement mechanism may comprise a motor, a worm gear and a drive gear. Optionally, the motor is further configured to drive a cam-mechanism, the cam-mechanism configured to activate the pluck-head to trap the at least one hair Advantageously, the system may further comprise a power storage unit. Variously, the power storage unit may be selected from at least one of a group consisting of electrochemical cells, batteries, chargeable cells, inductive power supply units, power harvesters, capacitors and combinations thereof.

According to particular embodiments, the dimensions of the casing are selected to be suitable to be held by one hand.

According to another aspect of the invention a method is taught for removing hair from a body by: providing a hair removal system comprising at least one pluck-head, at least one oscillator and at least one frame-displacement mechanism; the frame-displacement mechanism describing a displacement cycle; the pluck-head engaging at least one hair; the oscillator vibrating the pluck-head; transmitting vibrations to a root of the hair; and heating the root such that germinative cells therein are destroyed.

Still another aspect of the invention is to disclose a hair removal system comprising: a casing; at least one displacement carriage; at least one pluck-head mounted to the carriage, the pluck-head configured to trap hairs; and at least one frame-displacement mechanism configured to lift the displacement carriage thereby plucking the hair.

In other embodiments, the pluck control unit is configured to generate vibrations in the pluck-head. Parameters of the vibrations may be selected to provide a vibration energy sufficient to clean a superficial layer of skin. Alternatively or additionally, parameters of the vibrations may be selected to provide a vibration energy sufficient to generate heat in subcutaneous fat deposits so as to decompose the fat deposits. Such parameters may be selected from amplitude of vibration and frequency of vibration. Accordingly, some embodiments of the system are configured to combine epilation, peeling and fat reduction functionality.

BRIEF DESCRIPTION OF THE FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments of the present invention only, and are presented in the cause of providing what is believed to be the most useful and readily understood description of the principles and conceptual aspects of embodiments of the invention. In this regard, no attempt is made to show structural details in more detail than is necessary for a fundamental understanding of the embodiments; the description taken with the drawings making apparent to those skilled in the art how the several forms of the invention may be embodied in practice. In the accompanying drawings.

DESCRIPTION OF SELECTED EMBODIMENTS

Figure 1:
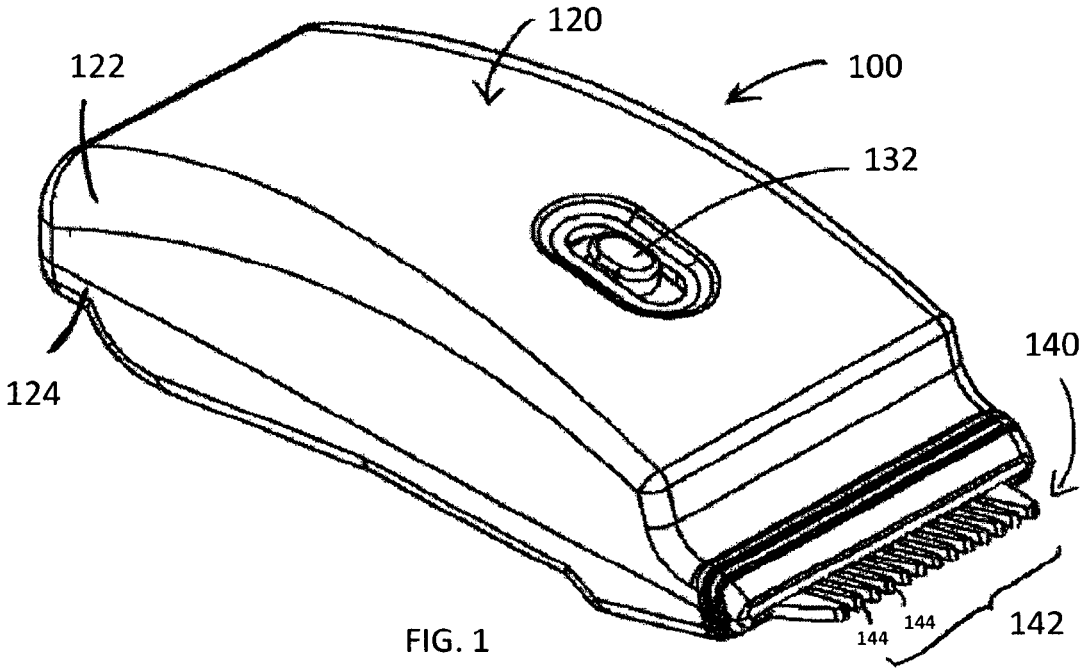
FIG. 1 is a schematic representation of an exemplary embodiment of the hair removal device.

Reference is now made to FIG. 1 which is a schematic diagram showing an exemplary embodiment of a hair removal device 100. The device is configured to provide a convenient method for a user to effect long term hair removal. It is a particular feature of the embodiment that the function of the device is intuitive and readily learnt by a user with no special training.

The external features of the hair removal device 100 of the embodiment include a casing 120, a power switch 132 and a pluck-head 140. The casing 120 which may include an upper cover 122 and a lower cover 124, may be of a size convenient for being held by one hand during operation. The power switch 132 may be conveniently positioned for operation by a user holding the device 100. During operation a user may orient the device 100 such that the pluck-head 140 engages a group of hairs (not shown).

The pluck-head 140 itself is configured to grip a plurality of hairs and to vibrate at such a frequency that vibrations are transmitted through each hair, thereby heating the base of the hair follicles and destroying germinative cells.

Accordingly, the pluck-head 140 typically comprises a continuous comb 142 having a plurality of movable teeth 144. The movable teeth 144 are configured to selectively spread and bunch together thereby opening and closing the comb 142 such that when hairs are introduced between the teeth 144, the comb may be closed thereby trapping the hairs.

As described in greater detail below in relation to FIG. 3 the pluck-head 140 is typically mechanically coupled to a head vibration mechanism 186 configured to apply high frequency vibrations to the trapped hairs.

It is particularly noted that unlike the hair-gripping elements used in prior art systems, the continuous comb 142 used in the pluck-head 140 of the exemplary embodiment 100 is a single component unit, For example, the prior art devices described in WO 2005/079687 and the prior art devices described in WO 2009/150645 all include tongs consisting of fingers having hair-gripping ends. It will be appreciated that when high frequency vibration are applied to elements having multiple components such as the prior art prongs, a large proportion of the energy of vibration is needed to move the components themselves; this energy is not transmitted to the hair but is effectively wasted. In contradistinction, single component units, such as the continuous comb 142 of the exemplary embodiment 100, use a far lower proportion of energy during transmission of the vibrations. Consequently, embodiments described herein are typically more energy efficient than the prior art devices.

Furthermore, unlike the devices described in the prior art, it is another feature of the exemplary embodiment 100 described herein that the pluck-head 140 may be further configured to pull the hair follicle from the skin once the base of the hair follicle has been damaged. In other embodiments, as described below in relation to FIG. 8, the pluck-head 3140 may be configured to pull out undamaged hairs.

Figure 2A:
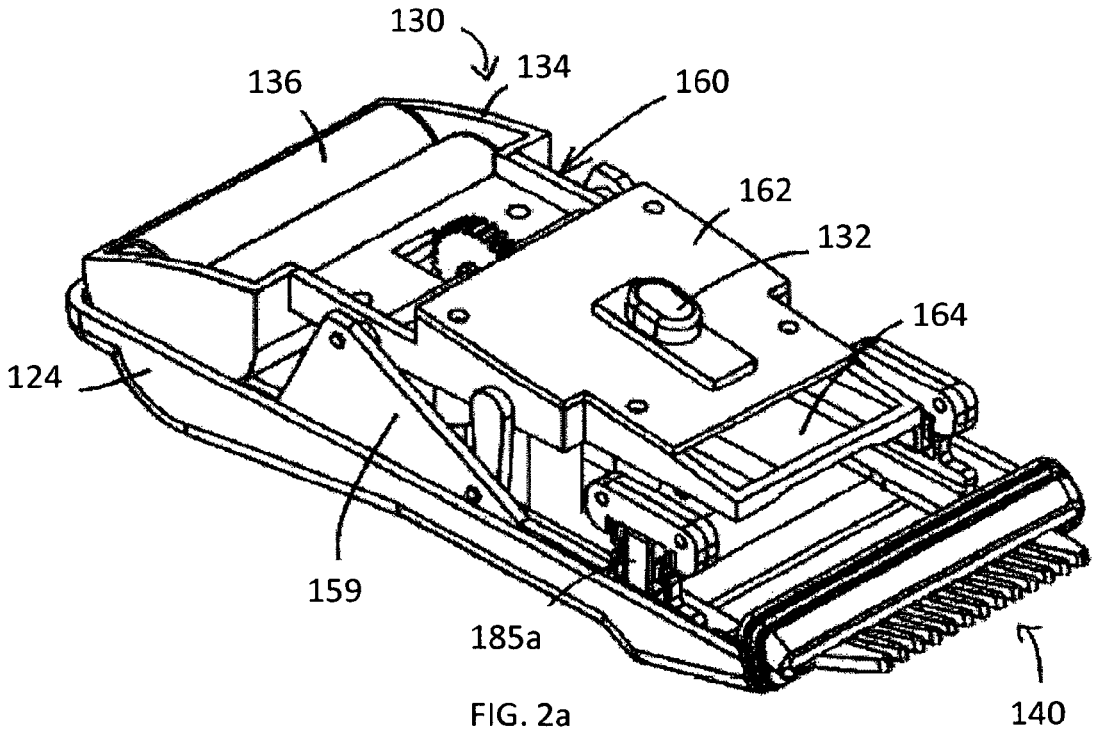
FIGS. 2*a-c* are further schematic representations of the exemplary embodiment with the casing removed revealing selected internal components of the system.
Figure 2B:
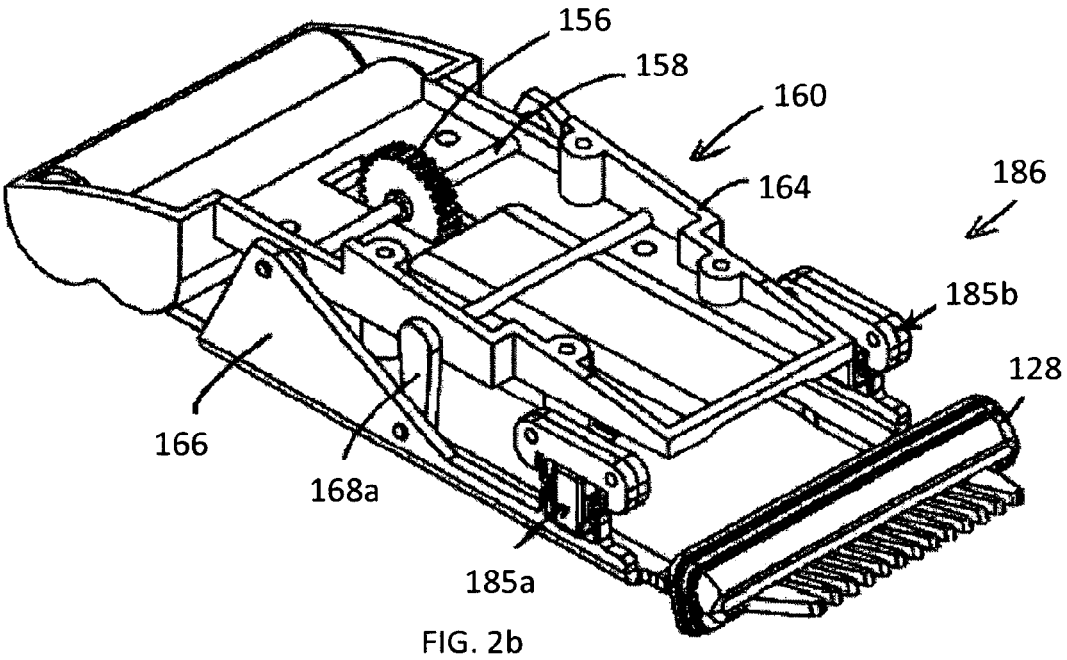
Figure 2C:
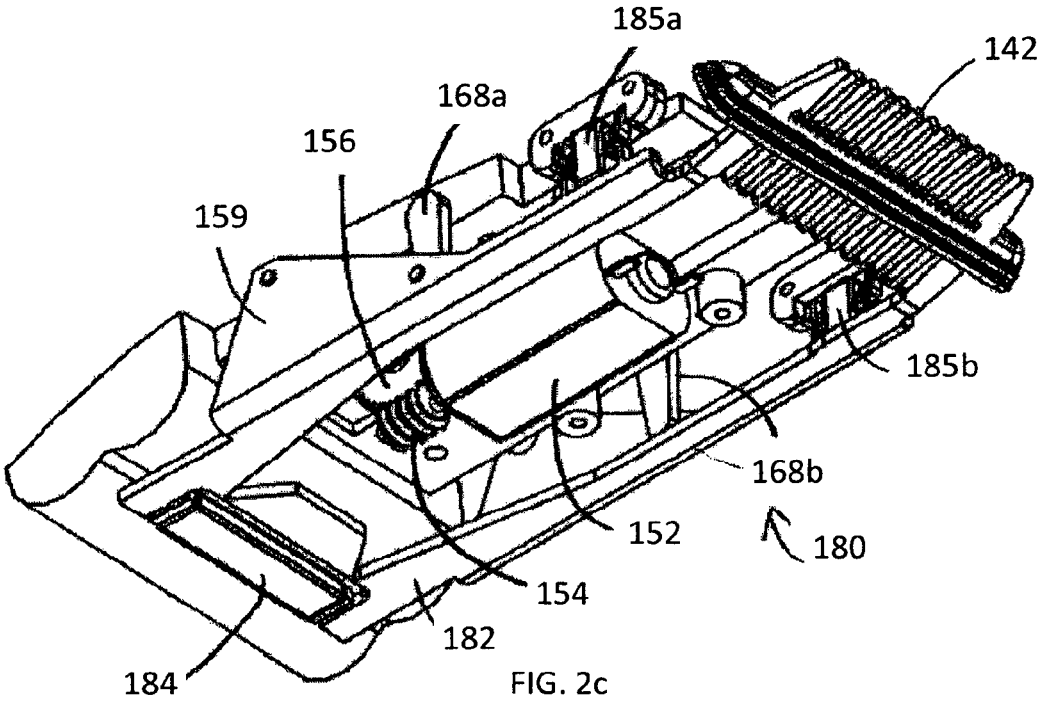

Reference is now made to FIGS. 2*a-c* showing selected internal components of the exemplary embodiment of the hair removal device 100. In FIG. 2*a*, the device 100 is shown with the upper cover 122 of the casing 120 removed revealing a power unit 130, an internal chassis 160 and a pluck control unit 180. In FIGS. 2*b* and 2*c* the device 100 is shown, from above and below respectively, with both the upper cover 122 and the lower cover 124 as well as the upper section 162 of the internal chassis 160 removed to reveal the main components of a frame displacement mechanism 150.

With particular reference to FIG. 2*a*, the power unit 130 includes the power switch 132, a battery housing 134 and two power cells 136. The power unit 130 is configured to provide power to the frame displacement mechanism 150 and the pluck control unit 180. Although only power cells 136 are described in the embodiments herein, other power sources may be used to power other embodiments of the hair removal device. Alternative power sources may include mains electricity, electrochemical cells, batteries, chargeable cells, inductive power supply units, power harvesters, capacitors and the like.

The internal chassis 160 has an upper section 162 and a lower section 164. The lower section 164 incorporates the battery housing 134 and may serve as a platform upon which other elements are mounted. The upper section 162 may include electrical components such as a power switch 132 and controlling circuitry. In some embodiments, the upper section 162 of the chassis 160 may comprise a printed circuit board providing the required electronics.

With particular reference now to FIGS. 2*b* and 2*c*, showing the hair removal device 100 from above and below respectively, it is noted that the frame displacement mechanism 150 includes a motor 152, a worm gear 154, a drive gear 156, an eccentric shaft 158 mounted upon the chassis 160 and a displacement-carriage 159.

The pluck control unit 180 and the pluck-head 140 are both mounted upon the displacement-carriage 159. The displacement-carriage 159 is mechanically coupled to the chassis 160 via a crankshaft 166 and two side arms 168*a*, 168*b* such that the frame displacement mechanism 150 is configured to generate a movement cycle for the pluck-head 140 during operation. The operational movement cycle is described in more detail below in relation to FIGS. 5*a-e*.

Figure 3A:
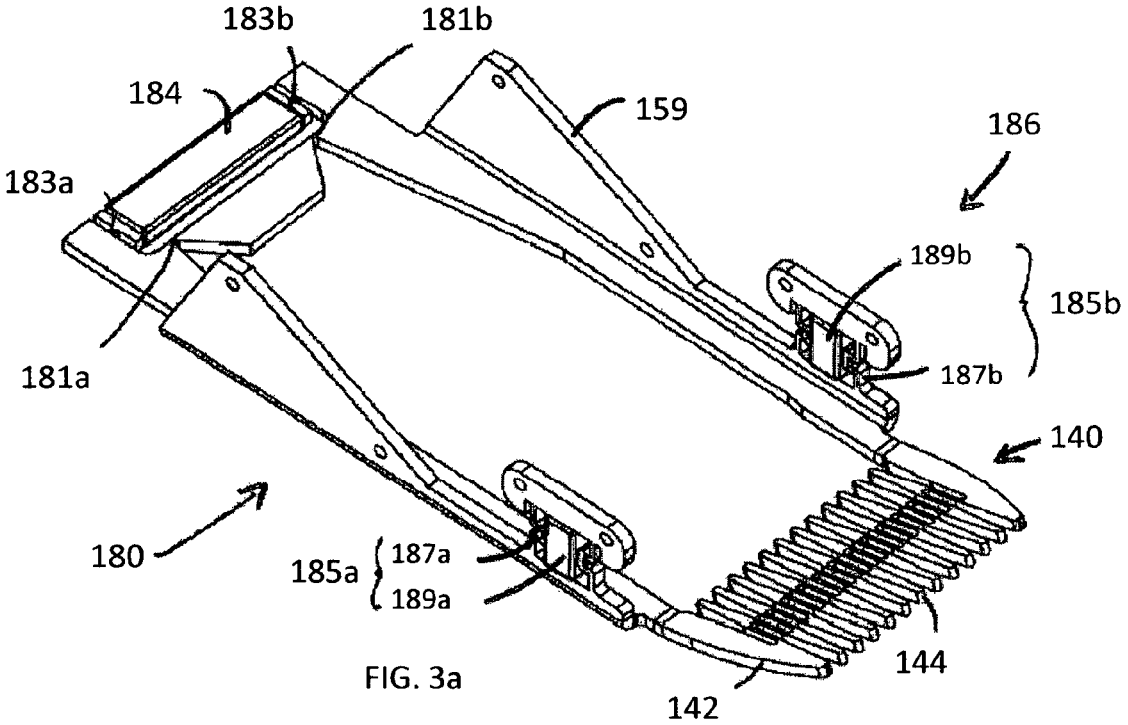
FIG. 3*a* is a schematic representation of a displacement carriage and pluck control unit for use in the exemplary embodiment.

Reference is now made to FIG. 3*a*, which schematically represents the displacement-carriage 159 alone so as to better explain its function. The pluck control unit 180 of the embodiment includes a force-transmission frame 182, a grip-actuator 184 and a head vibration mechanism 186.

The grip-actuator 184 is configured to control the movement of the teeth 144 of the pluck-head 140 such that the comb 142 may be opened and closed during operation in order to trap hairs. For example, the grip-actuator 184 may be a piezoelectric element coupled to electrode mounts 183*a*, 183*b* and configured to apply a force upon the mounts 183*a*, 183*b* when an electrical potential is applied thereacross. The force transmission frame 182 may be configured to transmit the force exerted by the grip-actuator 184 to the pluck-head 140. Accordingly, fulcrum points 181*a*, 181*b* may be provided about which the force-transmission frame 182 may pivot thereby amplifying the movement generated by the grip-actuator 184.

Although a piezoelectric electric grip-actuator 184 is described above, other embodiments of the hair removal device 100 may use alternate force generation elements as required, such as a motor, a solenoid or the like. It will be appreciated that in other embodiments of the device 100 various configurations of the force-transmission frame 182 may be preferred.

The pluck control unit 180 of the embodiment further comprises a head vibration mechanism 186 configured to apply high frequency vibrations to the pluck-head 140 such that the roots of hairs trapped therein are destroyed. The head vibration mechanism 186 of the embodiments includes a pair of oscillators 185*a*, 185*b*. Each oscillator 185*a*, 185*b* includes a spring 187*a*, 187*b* and a transducer 189*a*, 189*b*. The springs 187*a*, 187*b* are typically affixed to the displacement-carriage 159 at one end and to the chassis 160 at the other. The transducers 189*a*, 189*b* are configured to generate oscillations in the springs 187*a*, 187*b* thereby vibrating the displacement-carriage 159 and with it the pluck-head 140.

Typically, the transducers 189*a*, 189*b* are piezoelectric elements configured to oscillate with relatively small amplitude of say ten microns or so. The amplitude of the pluck-head oscillations depends upon the frequency of the oscillations as well as the relative masses of the displacement carriage 159 and the chassis 160. Accordingly, these masses may be selected to suit the requirements of the system. It is particularly noted that vibration frequencies of below around 150 kilohertz may be suitable for destroying the germinative cells at the roots of trapped hairs.

Although only piezoelectric transducers 189*a*, 189*b* are described above, other oscillators may be used with the system such as motors, solenoids, electrostatic elements and other such repeaters. In still other embodiments, the grip actuator 182 may itself be configured to oscillate the pluck-head 140, such that a single unit may serve as both the grip actuator 184 and head-vibration mechanism 184.

Figure 3B:
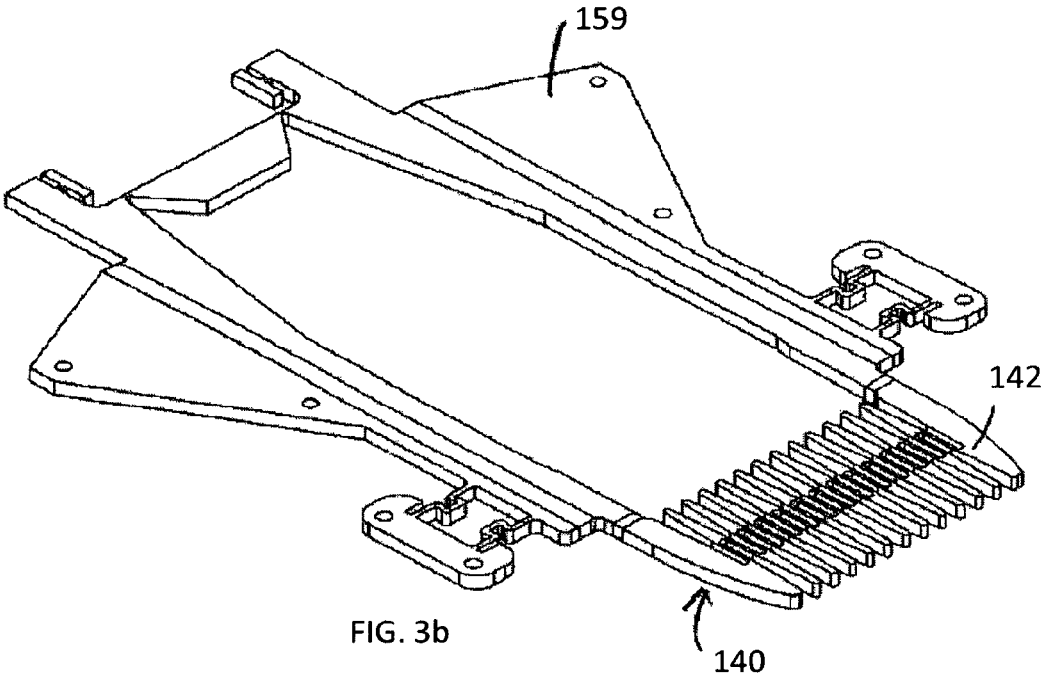
FIG. 3*b* is schematic representation of a sheet metal section stamped into the shape of the displacement carriage and pluck-head of the exemplary embodiment.

Referring now to FIG. 3*b*, it is noted that a particular feature of the continuous comb 142 of the pluck head 140 is that the displacement carriage 159 may be manufactured as a sheet metal section 159'. Thus, unlike the multi-piece hair gripping elements described in the prior art, embodiments of the displacement carriage 159 described herein may be readily stamped into shape.

Figure 4:
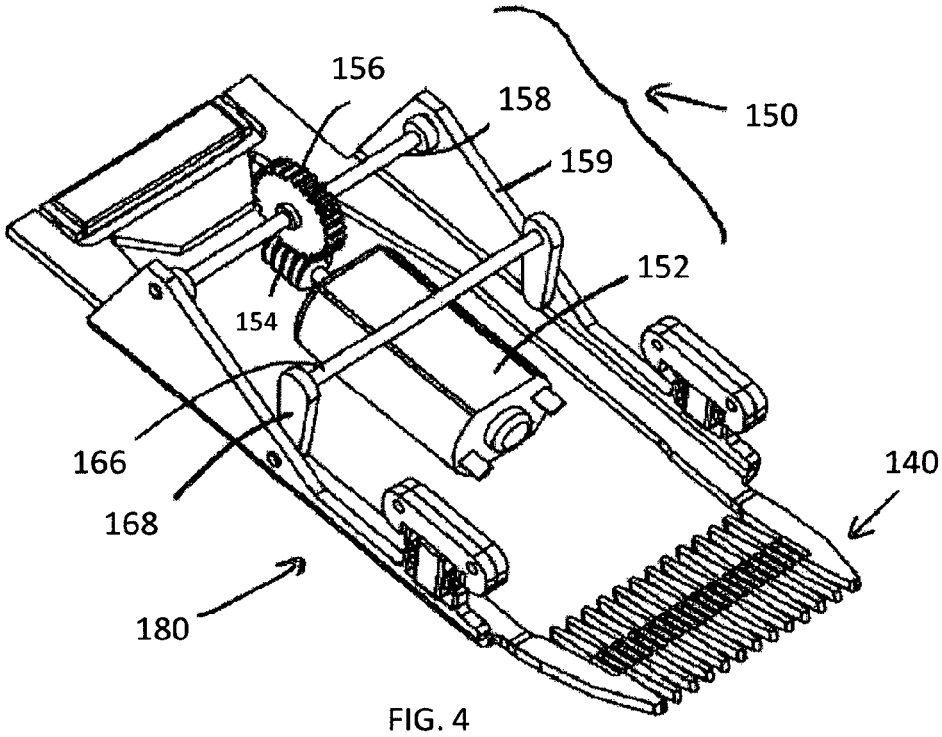
FIG. 4 is a schematic representation of the displacement carriage and frame displacement mechanism of the exemplary embodiment.

Reference is now made to FIG. 4, which schematically represents the displacement carriage 159 and the frame displacement mechanism 150 with the chassis removed. The frame displacement mechanism 150 is configured to generate a movement cycle during operation. The motor 152, which is mounted to the lower section 164 of the chassis 160 (not shown in FIG. 4), is configured to rotate the worm gear 154 which is engages the drive gear 156. The drive gear 156 is coupled to the carriage 159 via the shaft 158. It is a particular feature of the frame displacement mechanism that the shaft 158 is coupled to the drive gear 156 eccentrically such that during each rotation the of the drive gear 156, the displacement-carriage 159 describes a predetermined displacement cycle.

The operational movement cycle of the pluck head 140 as it plucks a hair 220 from a body 200 is illustrated by FIGS. 5*a-e* and FIGS. 6*a-d* showing schematic side views of the pluck-head 140, the head vibration mechanism 186, the displacement-carriage 159 and the frame displacement mechanism 150 at various stages during the displacement cycle.

Figure 5A:
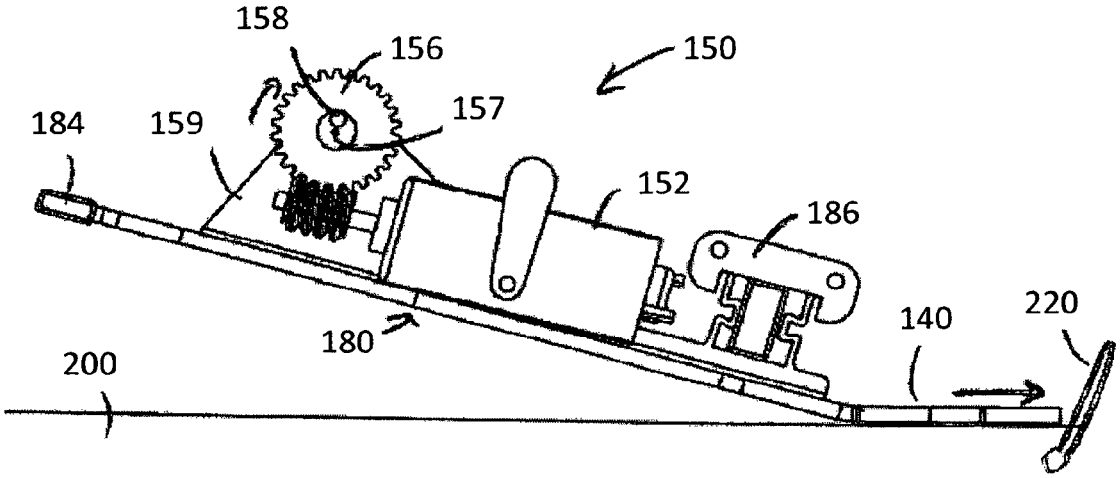
FIGS. 5*a-e* show schematic side views of the system illustrating the device at various stages of its operational cycle.
Figure 6A:
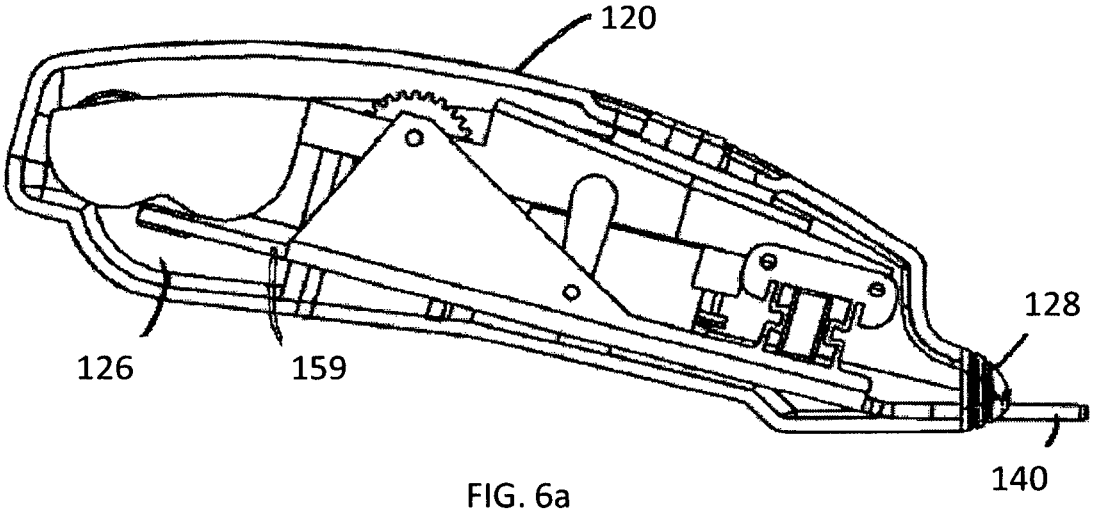
FIGS. 6*a-d* show further schematic side view sections of the exemplary embodiment during the displacement cycle.

During the cycle, the eccentric shaft 158 describes a circle about the center 157 of the drive gear 156. At stage 1, as shown in FIGS. 5*a* and 6*a*, the eccentric shaft 158 is situated above the center 157. Consequently, the displacement carriage 159 is at its lowest extreme adjacent to the body 200.

Figure 5B:
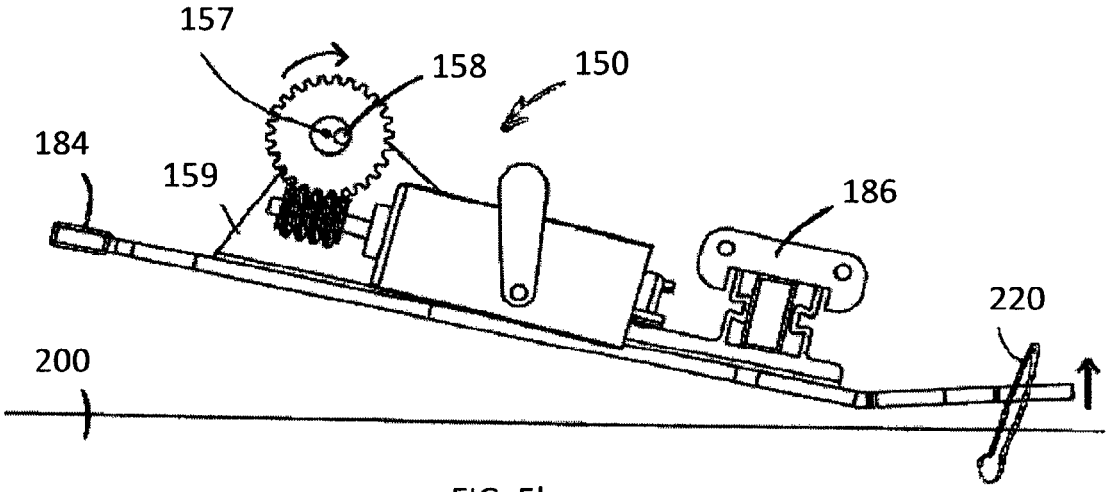
Figure 6B:
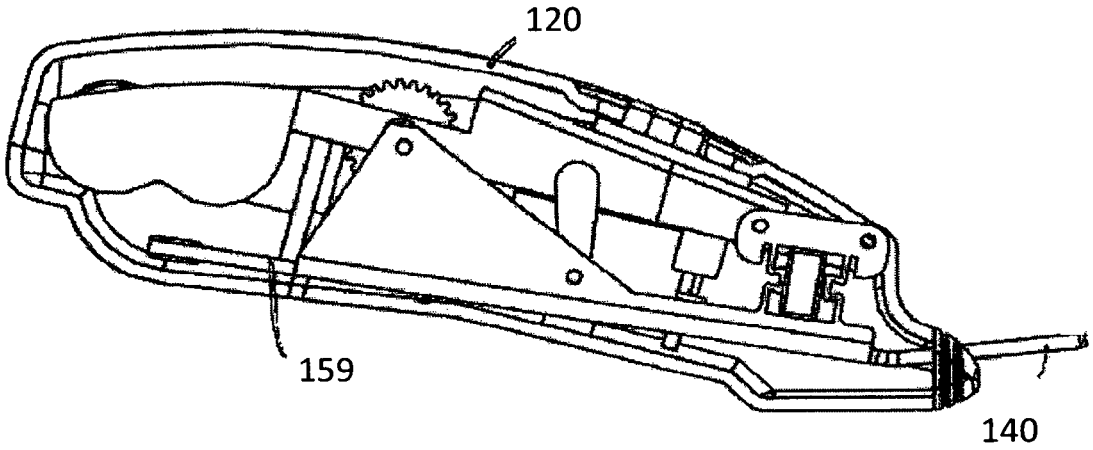

At stage 2, as shown in FIGS. 5*b* and 6*b*, the eccentric shaft 158 is situated to the right of the center 157. Consequently, the displacement carriage 159 is shifted forwards towards the hair follicle 220. During stage 2, the grip-actuator 182 may be activated to close the pluck-head 140 thereby trapping the hair 220 between its teeth. It will be appreciated that although only one hair 220 is represented in FIG. 2*a*, typically more than one hair follicle may be trapped by the pluck-head 140 during a single cycle.

Figure 5C:
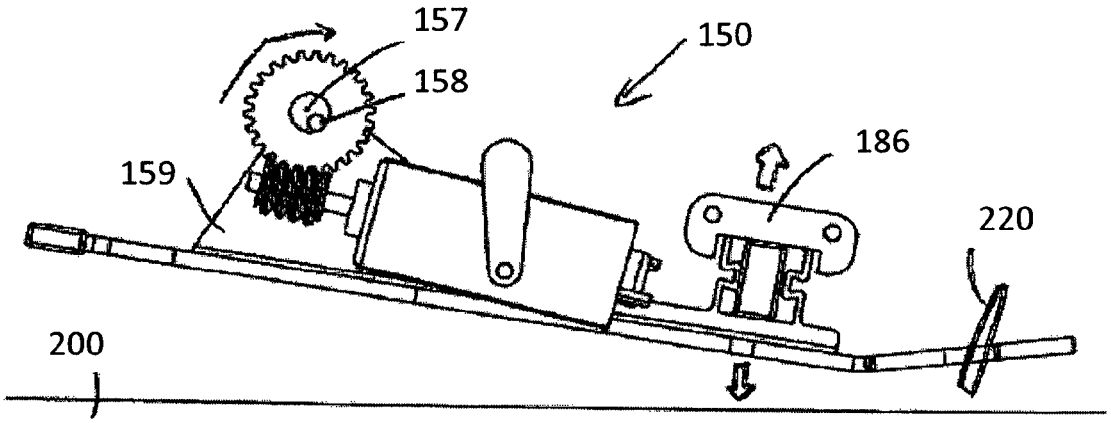
Figure 6C:
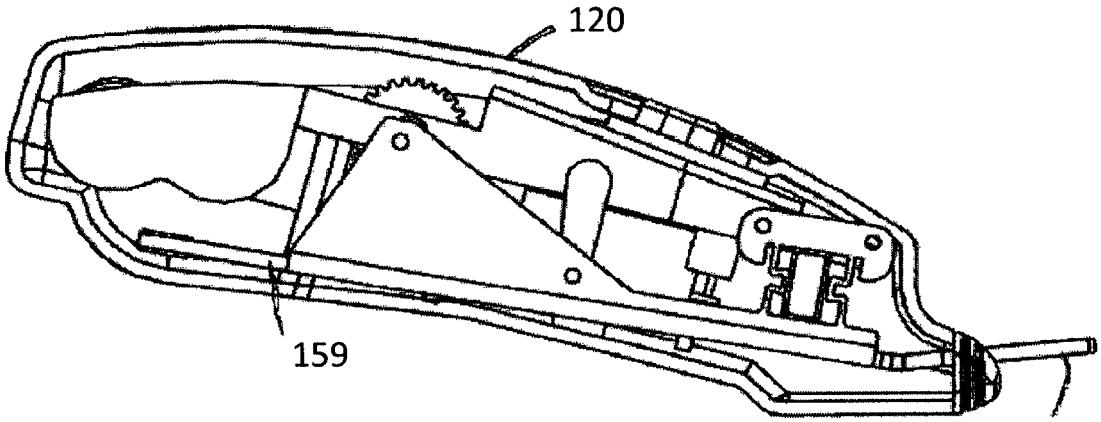

At stage 3, as shown in FIGS. 5*c* and 6*c*, the eccentric shaft 158 is situated below the center 157. Consequently, the displacement carriage 159 is lifted away from the body 200 thereby pulling the hair 220 taut. At this stage the head vibration mechanism 186 is typically activated to vibrate the hair 220 at a high frequency such that acoustic waves may be transmitted through the hair 220 to the root, destroying germinative cells. Concurrently, the hair 220 is also plucked out of the body 200.

It is a particular feature of the exemplary embodiment of the hair removal device 100 that the pluck-head 140 and frame displacement mechanism 150 are able to maintain the hair follicle in tension while the hair follicle is vibrated such that the acoustic waves are effectively transmitted therethrough. It is noted that this feature represents a significant advantage over prior art systems such as described in WO 2005/079687 and WO 2009/150645, which do not include any such tensing mechanism.

Figure 5D:
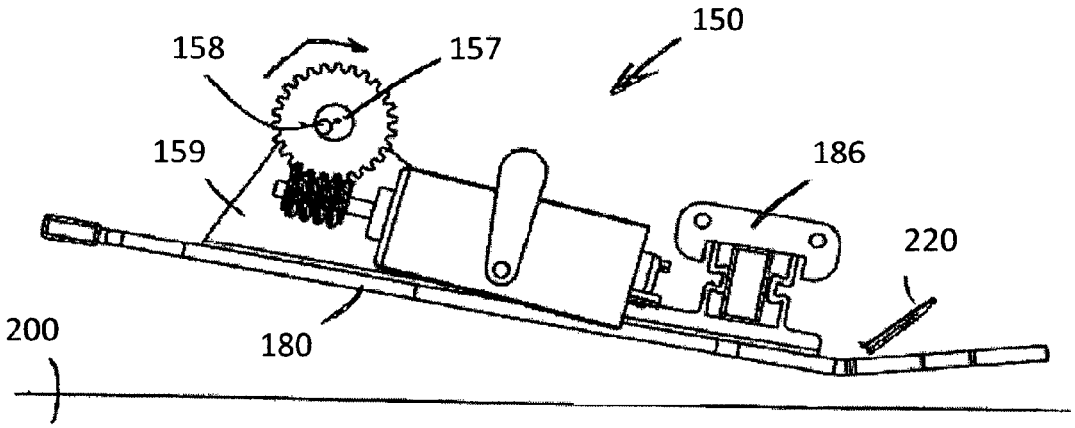
Figure 6D:
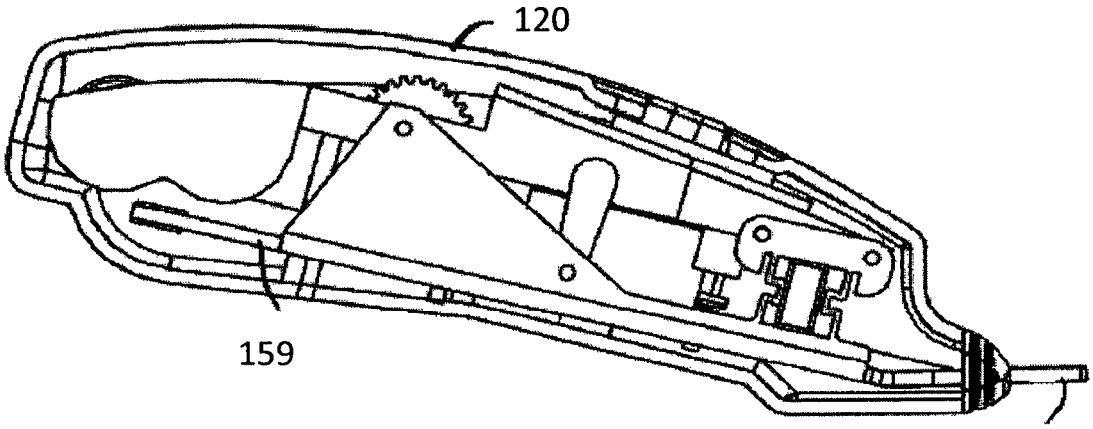

At stage 4, as shown in FIGS. 5*d* and 6*d*, the eccentric shaft 158 is situated to the left of the center 157 and the displacement carriage 159 is moved backwards. At this stage, the grip-actuator 182 may be activated to open the pluck-head 140 thereby releasing the trapped hair.

Figure 5E:
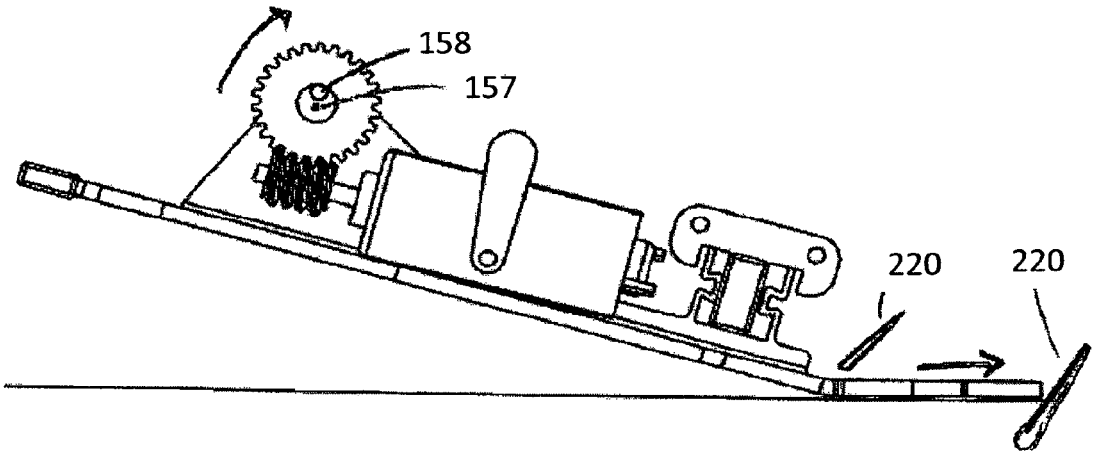

At stage 5, as shown in FIG. 5*e*, the eccentric shaft 158 has returned to its initial position above the center 157. Consequently the displacement carriage is moved downwards towards the body 200 ready to engage the next hair 220'.

Accordingly, a method for removing hair from a body is disclosed herein including the steps of: providing a hair removal system comprising at least one pluck-head, at least one oscillator and at least one frame-displacement mechanism; the frame-displacement mechanism describing a displacement cycle; trapping at least one hair follicle with the pluck-head; vibrating the pluck-head; transmitting vibrations to the root of the hair follicle; and thereby heating the root such that germinative cells therein are destroyed.

FIGS. 6*a-d* show schematic side view sections of the device 100 including the casing 120 during stages 1 to 4 of the displacement cycle. It is noted that the casing 120 includes a depression 126 formed within its lower cover 124. The depression 126 is provided to accommodate the displacement carriage 159 during stage 2 and stage 3 of the displacement cycle, during which the pluck-head 140 is lifted relative to the nose 128 of the casing 100.

Figure 7A:
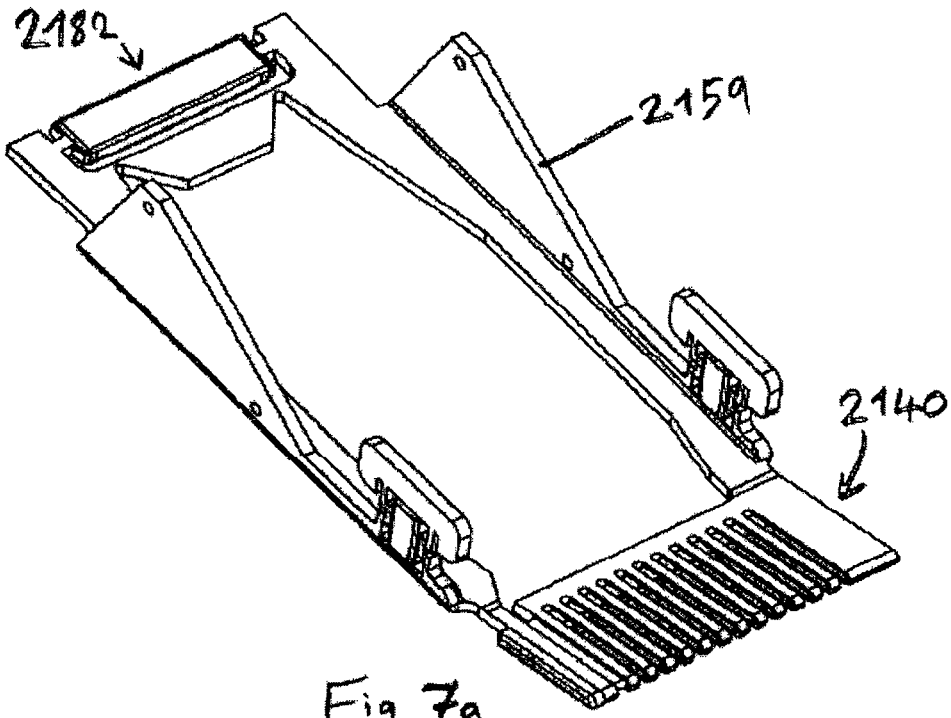
FIGS. 7*a* and 7*b* show an alternative embodiment of the hair removal device.
Figure 7B:
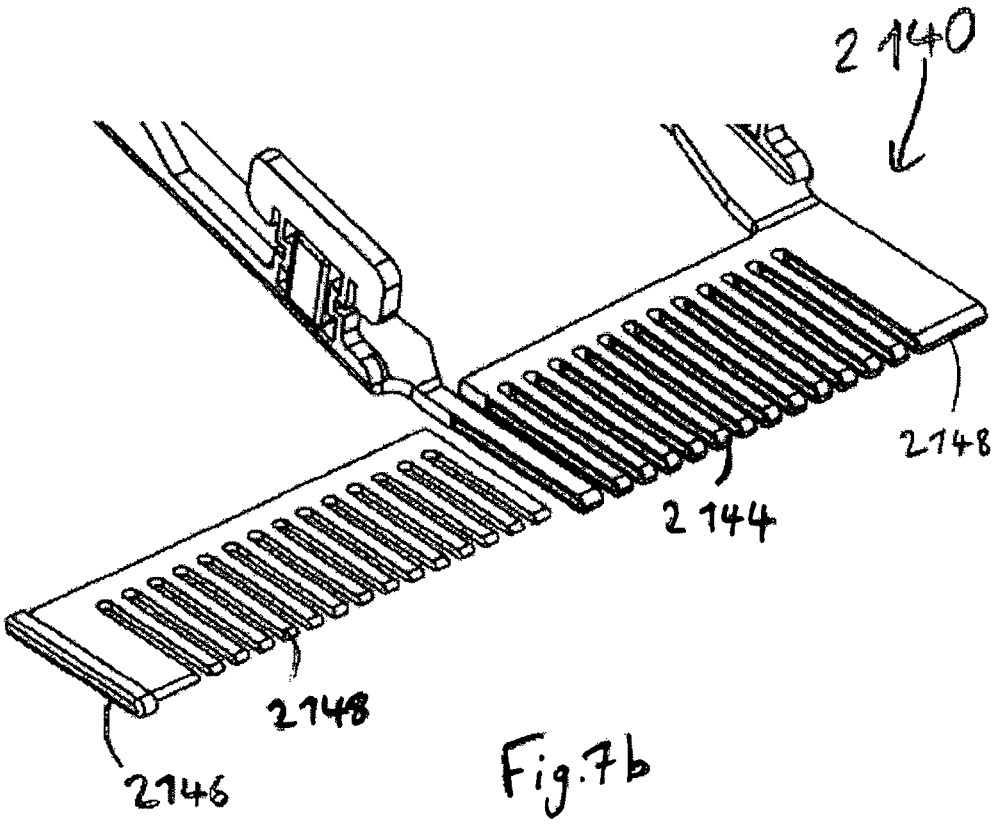

It will be appreciated that other embodiments of the hair removal device may use alternative configurations of its functional components. By way of an illustrative example reference is now made to FIGS. 7*a* and 7*b* showing an isometric view of an alternative embodiment for the displacement carriage 2159 and an exploded view of an alternate embodiment of the pluck-head 2140 respectively. It is noted that the alternative embodiment of the pluck-head includes an outer comb 2142 and an inner comb 2146. The inner comb 2146 is configured to nest slidably within the outer comb 2142 such that the inner teeth 2148 interlock with the outer teeth 2144. The grip actuator 2182 may be used to urge the teeth together thereby trapping hairs therebetween. Still further embodiments of the device may be preferred to suit requirements and changing needs.

Figure 8:
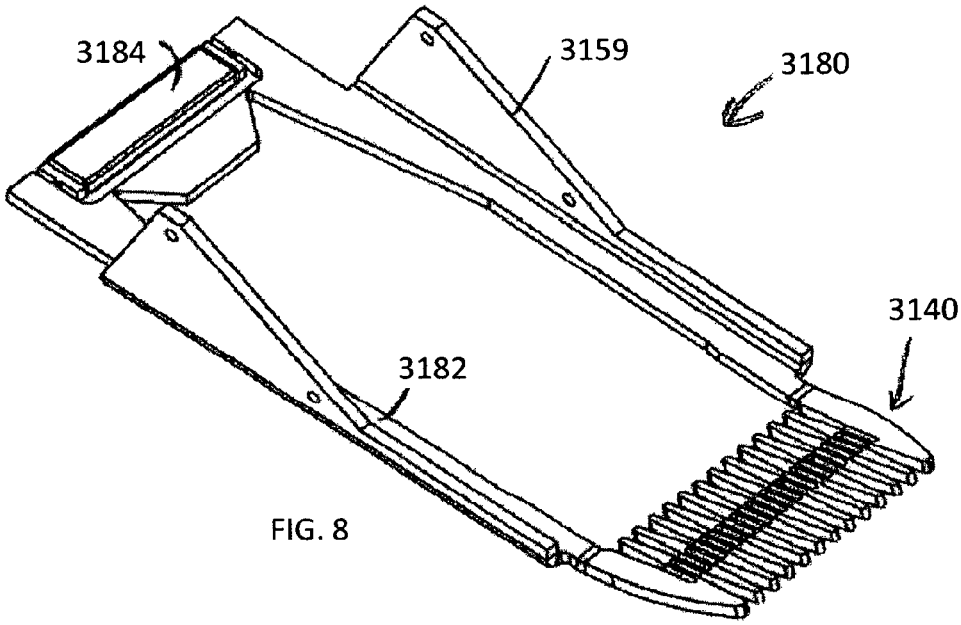
FIG. 8 is a schematic representation of alternative embodiment of a displacement carriage and pluck control unit.

Although the pluck control unit 180 of the exemplary embodiment described above includes both a grip actuator 184 and a head vibration mechanism 184, it will be appreciated that the action of the frame displacement mechanism 150 may be sufficient to pluck hairs from a body without the action of the vibration mechanism 184. Referring now to FIG. 8 showing a schematic representation of an alternative embodiment of the displacement carriage 3159 and pluck control unit 3180 is presented.

The pluck control unit 3180 of the alternative embodiment includes a force transmission frame 3182 and a grip-actuator 3184 configured to open and close the pluck-head 3140 carried by a displacement carriage 3159. However in contradistinction to the pluck control unit 180 of the exemplary embodiment described above, the alternative embodiment of the pluck control unit 3180 does not include a separate head vibration mechanism. Accordingly, during the cycle of the frame displacement mechanism (not shown) of the alternative embodiment, hairs are first intercepted by the pluck-head 3140 then the grip-actuator 3184 closes the pluck-head 3140 gripping the hair which may be pulled upwards with the movement of the frame displacement mechanism. Thus the alternative embodiment may be configured to pluck the hair from the body.

It is noted that the pluck control unit 3180 may be further configured to provide cosmetic treatment such as peeling or fat reduction. Peeling is a cosmetic treatment used to remove dead cells from the surface layer of the skin. Because, the regenerated skin layer may be smoother and less wrinkled than the old skin, peeling is a popular method for improving and smoothing the skin texture. Typically chemical solutions are applied which cause the dead skin cells to peel off. However, it has been found that high energy vibrations adjacent to the skin may also provide such a peeling effect.

High energy vibration may be capable of destroying germ bodies, exfoliating the superficial layer of skin, causing the cleaning effect and generating heat. Application of the high energy vibration wave to the face may effectively cause cleaning of the superficial layer of skin, exfoliation of waste matter, removal of pimples and removal of fat or cosmetic emulsion residue from pores of the skin. In addition, the vibrations may expedite circulation of the blood to activate the tissue or texture. Also, relaxation of muscles is caused, and spots, wrinkles or sags can be removed.

Furthermore, application of high energy vibrations to fleshy regions of the body may reduce fat deposits under the skin of the body part. Heat generated under the skin by the vibrations may decompose the subcutaneous fat. The subcutaneous fat thus decomposed can be absorbed in blood vessels or lymphatic vessels and removed as waste.

Referring back to FIG. 8, the grip-actuator 3184 of the pluck control unit may be configured to generate vibrations by opening and closing the pluck head 3140 in a periodic manner. It is particularly noted that such vibrations generated by the grip-actuator may be parallel to the surface of the skin. Alternatively, in other embodiments an orthogonal component to the vibration may be introduced perhaps using a head vibration mechanism such as described herein.

The energy of vibration of the pluck head 3140 depends upon the frequency and amplitude of the vibrations. Accordingly, vibration energy may be selected so as to produce a peeling effect or fat degeneration as required. Where appropriate a frequency around one kilohertz or so may be used, in combination with a low amplitude vibration. The combination of high frequency and low amplitude may be particularly useful as it may allow a peeling effect while also preventing heat from penetrating deep into the skin.

In still further embodiments of the hair removal system, the functionality of various elements may be combined into a single unit. Accordingly, the frame displacement mechanism 150 (FIG. 4) may be adapted such that the motor 152 also serves as a grip actuator or a head vibration mechanism at various stages of the displacement cycle.

Figure 9A:
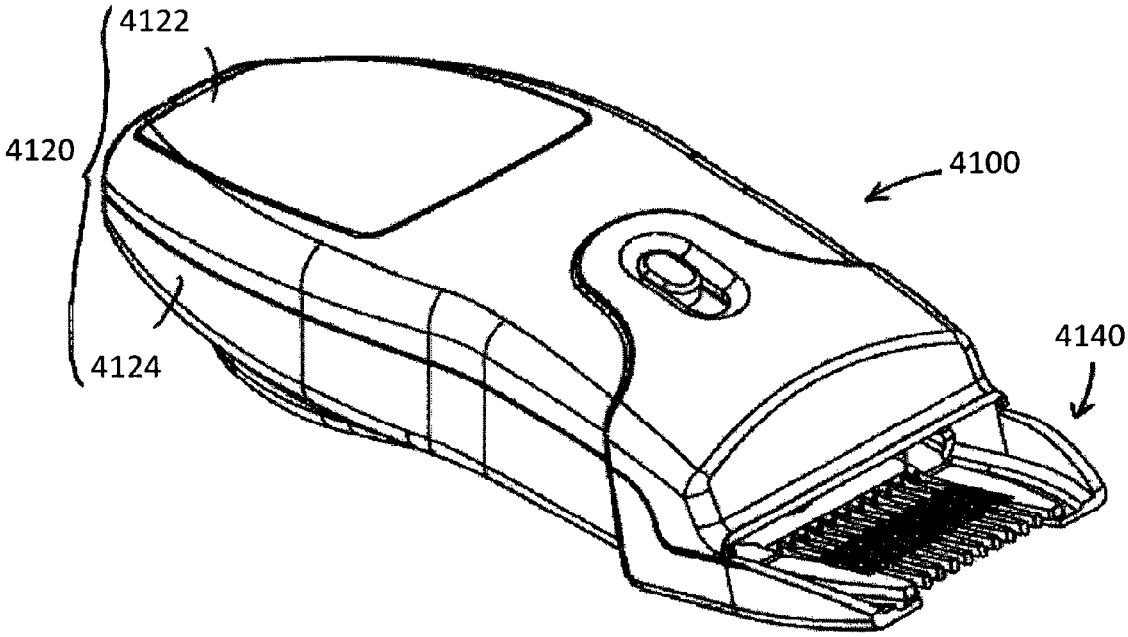
FIGS. 9*a-f* are schematic representations of still a further embodiment of the hair removal device in which the grip of the pluck-head is actuated by the motor.
Figure 9B:
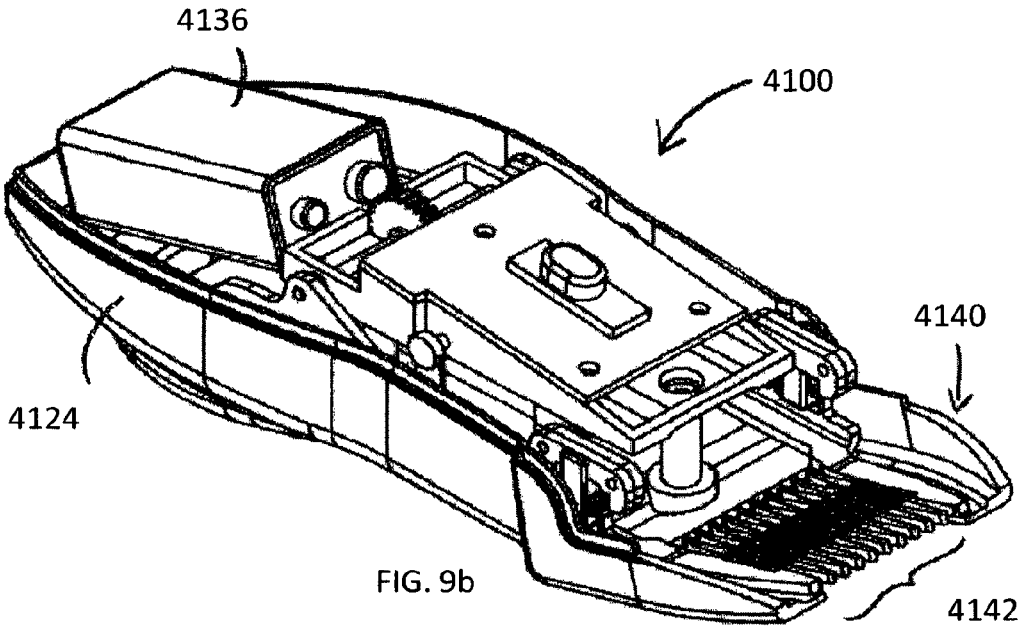
Figure 9C:
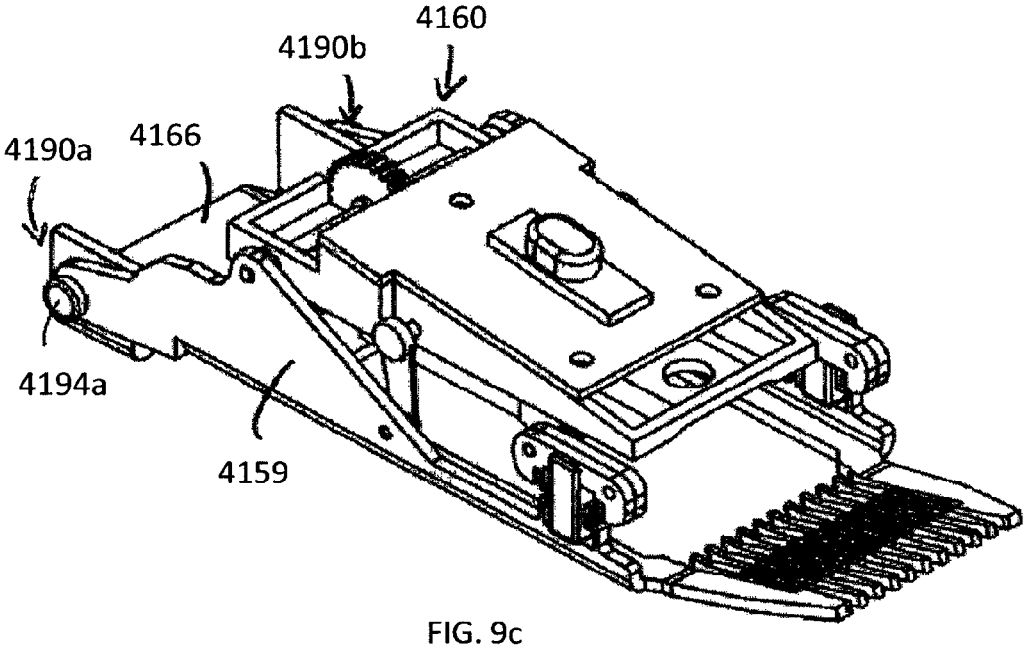
Figure 9D:
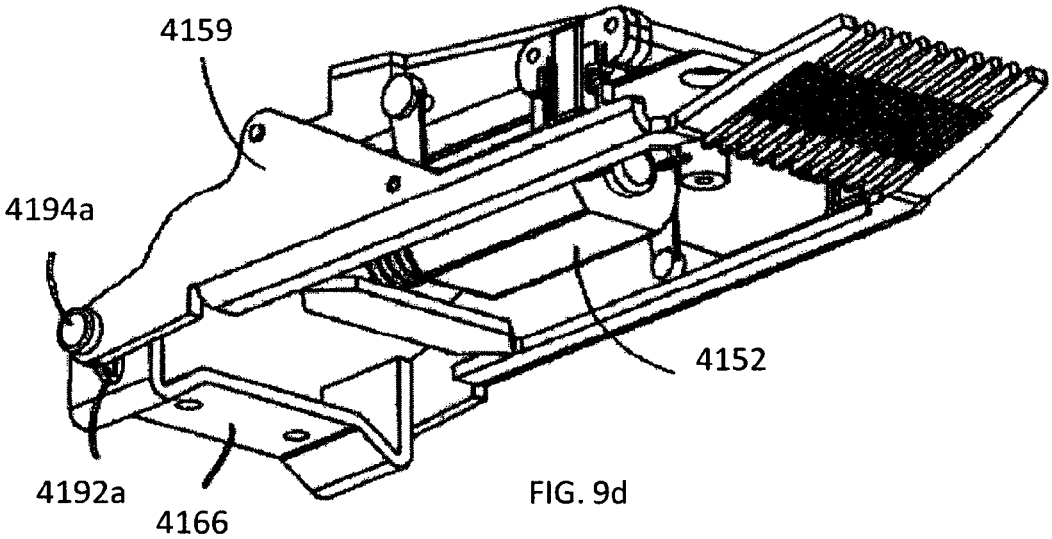
Figure 9E:
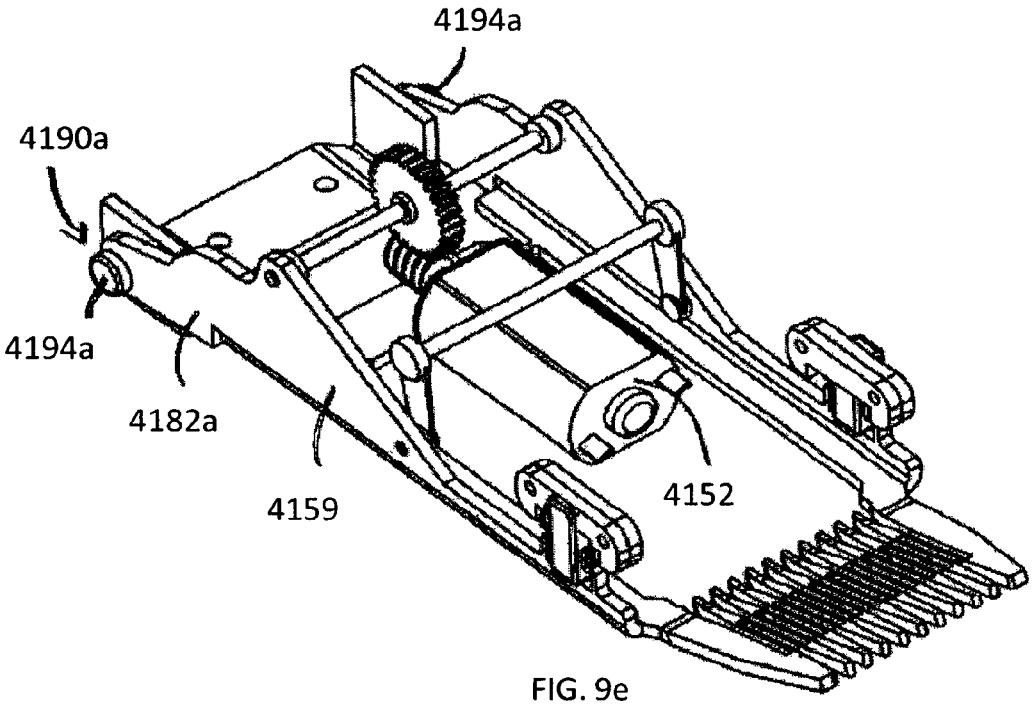
Figure 9F:
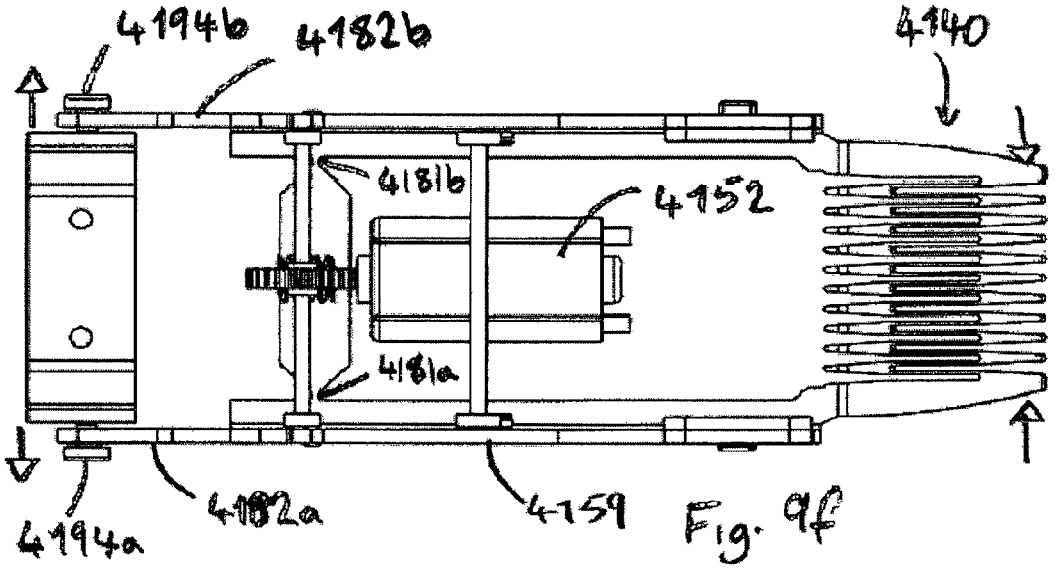

For example, reference is now made to FIGS. 9*a-f* showing various views of a further embodiment of the hair removal device 4100 in which the grip action of the pluck-head 4140 is controlled the motor 4152. FIG. 9*a* is an isometric projection of the hair removal device 4100. FIG. 9*b* represents the device 4100 with the upper cover 4122 of the casing 4120 removed. FIG. 9*c* is an isometric projection of just the internal elements of the device 4100. FIG. 9*d* is an isometric projection of the underside of the internal elements of the device 4100. FIG. 9*e* is an isometric projection of the displacement carriage 4159 and the frame displacement mechanism 4150 of the device 4100. FIG. 9*f* is a top view of the elements featured in FIG. 9*e*.

It is noted that the embodiment of the hair removal device 4100 represented in FIGS. 9*a-f* differs from the exemplary embodiment described above in relation to FIGS. 1-4 in a number of ways. In particular, the embodiment represented in FIGS. 9*a-f* includes an additional rear section 4166 of the chassis. The rear section 4166 of the chassis is coupled to the displacement carriage 4159 of the via two couplings 4190*a*, 4190*b*. As described below rear section 4166 of the chassis and the two couplings 4190*a*, 4190*b*, are configured to provide grip-actuation functionality thereby obviating the necessity for a separate grip-actuator such as the piezoelectric element 184 (FIG. 2*c*) of the exemplary embodiment.

Figure 10A:
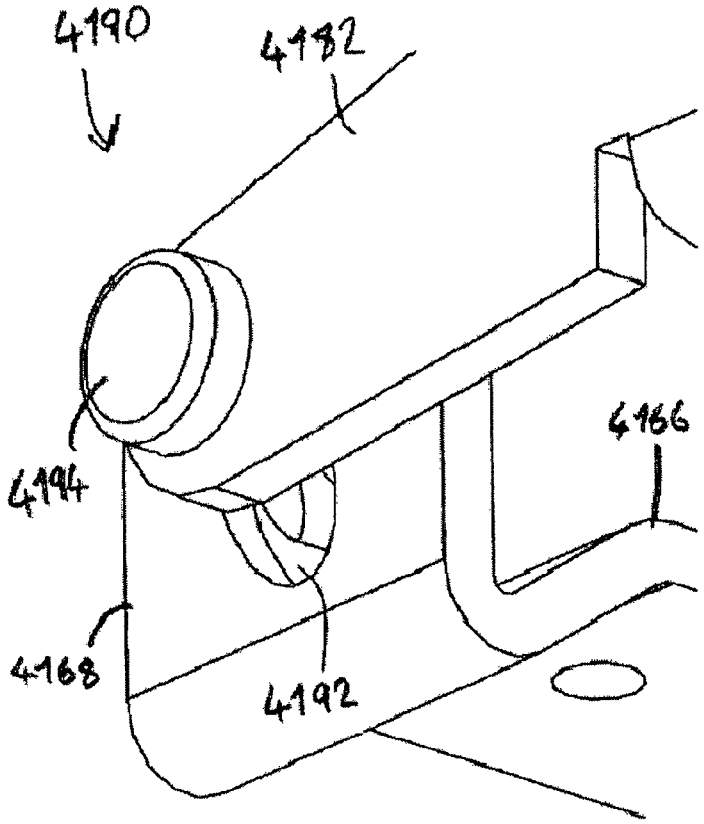
FIG. 10*a-d* are schematic views of an exemplary coupling between the chassis and the displacement carriage of the embodiment of FIGS. 9*a-f*.

The grip-actuation functionality of the embodiment of FIGS. 9*a-f* is explained now with reference to FIGS. 10*a-d*. FIG. 10*a* is a detail showing one of the couplings 4190*a*, 4190*b* between the displacement carriage 4159 and the rear section 4166 of the chassis. Each coupling 4190 includes a cam groove 4192 and a cam follower 4194. The cam groove 4192 is formed within the rear section 4166 of the chassis and the cam follower 4194, which may be an element such as a threaded pin, a protrusion or the like, is mounted upon a side arm 4182 of the displacement carriage 4159.

Figure 10B:
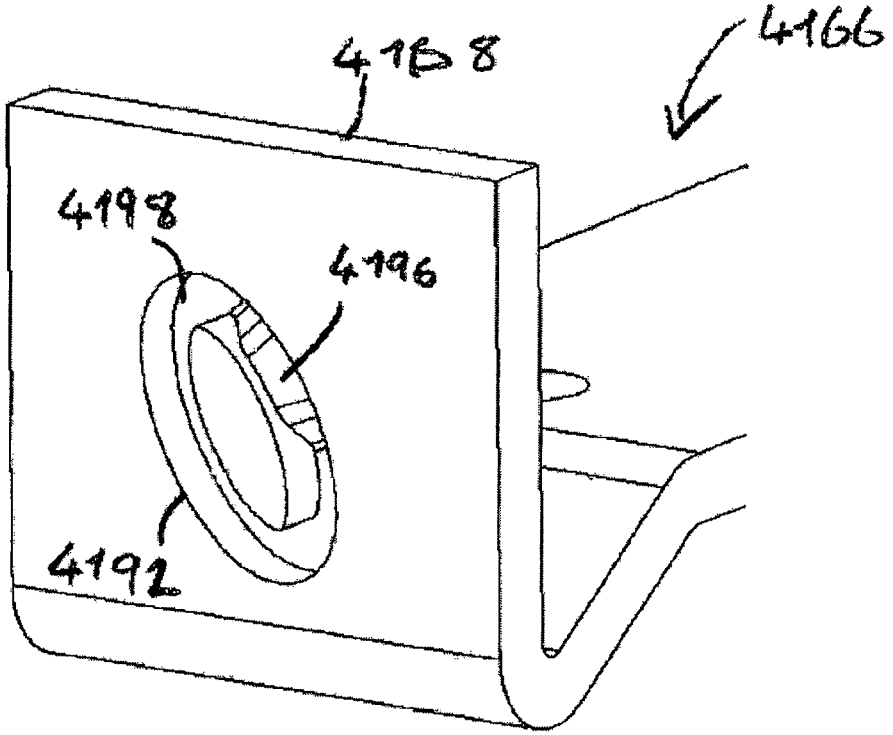

Referring to FIG. 10*b* showing the cam groove 4192 formed in a wing 4167 of the rear section 4166 of the chassis, it is noted that the cam groove 4192 includes a raised portion 4196 and a recessed portion 4198. During the displacement cycle of the displacement carriage 4159, the cam follower 4194 is configured to travel around the cam groove 4192.

Figure 10C:
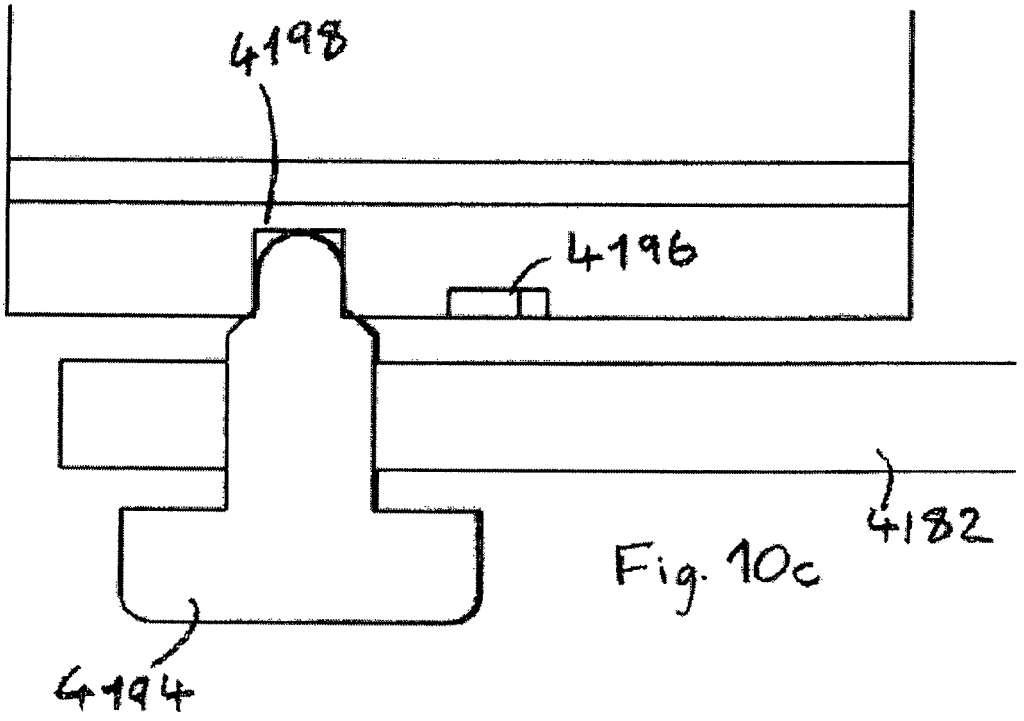
Figure 10D:
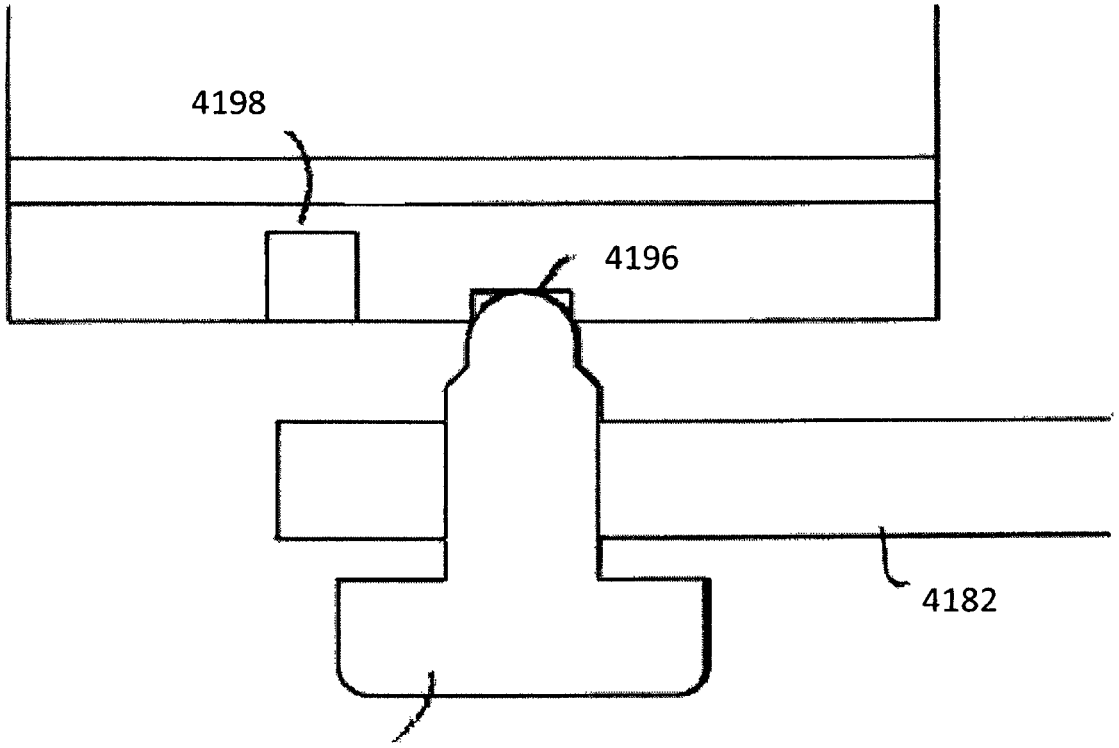

FIGS. 10*c* and 10*d* show cross sections of the coupling 4190 at two points during the displacement cycle of the displacement carriage 4159. With particular reference to FIG. 10*c*, the cam follower 4194 is represented in a recessed portion 4198 of the cam groove 4192. In FIG. 10*d*, the cam follower 4194 is represented in a raised portion 4196 of the cam groove 4192.

It is particularly noted that when the cam follower 4194 is at the raised portion 4196 of the cam groove 4192, a lateral force is exerted upon the side arm 4182 of the displacement carriage 4159, pushing it away from the wing 4167 of the rear portion of the chassis 4166.

Referring back now to FIG. 9*f*, it is noted that the lateral forces thus exerted upon the side arms 4182*a*, 4182*b* of the displacement carriage 4159 may provide moments around two fulcrum points 4181*a*, 4181*b* such that the displacement carriage 4159 serves as a force transmission frame transmitting opposing lateral forces to act on either side of the pluck-head 4140. Accordingly, the teeth 4144 of the pluck-head 4140 may be pushed together thereby closing the pluck-head 4140. In this manner hairs may be trapped within the pluck-head 4140. It will be appreciated that such a cam mechanism may be used to open and close the pluck-head as required during the operation cycle allowing the motor 4152 to function as the grip-actuator.

The abovedescribed embodiment is presented for illustrative purposes only, other cam paths may be used preferred as appropriate to suit other operation cycles as required.

Thus various embodiments described hereinabove provide combined systems for hair removal, peeling treatment and fat deposit reduction. The systems may be handheld and their operation is intuitive such that typically they may be operated by unskilled practitioners.

The scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. A hair removal system configured to destroy germinative cells at a base of at least one hair follicle, said system comprising:

a casing;

at least one pluck-head capable of trapping at least one hair and capable keeping said trapped hair at tension;

at least one oscillator mechanically coupled to said pluck-head and to said casing, wherein said at least one oscillator is configured to vibrate said pluck-head such that when the hair is trapped by said pluck-head, vibrations transmitted to the base are sufficient to destroy the germinative cells, and wherein said pluck-head is lifted away from the body, while said oscillator is vibrating; further comprising a frame-displacement mechanism, wherein said frame displacement mechanism comprising an eccentric shaft coupled to a displacement carriage.

2. The system of claim 1, wherein said vibrations are substantially in the direction orthogonal to the surface of the skin.

3. The system of claim 1, wherein said pluck-head comprises a single unit.

4. The system of claim 1, wherein said pluck-head comprises at least one comb having a plurality of movable teeth.

5. The system of claim 1, further comprising a pluck control unit configured to activate said pluck-head to trap the at least one hair.

6. The system of claim 5, wherein said pluck control unit comprises at least one actuator and at least one force transmission frame.

7. The system of claim 5, wherein said pluck control unit comprises at least one grip actuator selected from at least one of a group consisting of: a piezoelectric element, a motor, a solenoid and combinations thereof.

8. The system of claim 7, wherein said grip actuator comprises said oscillator.

9. The system of claim 5, wherein said pluck control unit is configured to generate vibrations in said pluck-head.

10. The system of claim 9, wherein parameters of said vibrations are selected to provide a vibration energy sufficient to clean a superficial layer of skin.

11. The system of claim 10, wherein said parameters are selected from amplitude of vibration and frequency of vibration.

12. The system of claim 9, wherein parameters of said vibrations are selected to provide a vibration energy sufficient to generate heat in subcutaneous fat deposits so as to decompose said fat deposits.

13. The system of claim 9, wherein said system is configured to combine epilation, peeling and fat reduction functionality.

14. The system of claim 1, wherein said oscillator comprises a transducer.

15. The system of claim 14, wherein said transducer is selected from at least one of a group consisting of: a piezoelectric element, a motor, a solenoid and combinations thereof.

16. The system of claim 1, wherein said oscillator further comprises a spring.

17. The system of claim 1, wherein said oscillator is configured to vibrate at a frequency below 150 kilohertz.

18. The system of claim 1, wherein said frame-displacement mechanism is configured to drive said pluck-head forward relative to said casing.

19. The system of claim 1, wherein said frame displacement mechanism is configured to lift said pluck-head thereby pulling on said at least one hair held thereby.

20. The system of claim 1, wherein said frame-displacement mechanism comprises a motor, a worm gear and a drive gear.

21. The system of claim 20 wherein said motor is further configured to drive a cam-mechanism, said cam-mechanism configured to activate said pluck-head to trap said at least one hair.

22. The system of claim 1, further comprising a power storage unit.

23. The system of claim 22, wherein said power storage unit is selected from at least one of a group consisting of electrochemical cells, batteries, chargeable cells, inductive power supply units, power harvesters, capacitors and combinations thereof.

24. The system of claim 1, wherein dimensions of said casing are selected to be suitable to be held by one hand.

25. The system of claim 1, wherein said pluck-head is configured to engage a plurality of the hair.

26. A method for removing hair from a body comprising:

engaging at least one hair with a pluck-head;

lifting said pluck-head such that it does not touch the skin and creating tension in said at least one engaged hair;

transmitting vibrations to the root of said trapped hair; and heating said root such that germinative cells therein are destroyed; wherein the pluck-head is coupled with a frame-displacement mechanism, wherein said frame-displacement mechanism comprises an eccentric shaft coupled to a displacement carriage.

27. The method of claim 26, wherein said transmitted vibration is substantially in the direction orthogonal to the surface of said skin.

* * * * *